US005749195A

United States Patent [19]

Laventure

[11] Patent Number: 5,749,195

[45] Date of Patent: May 12, 1998

[54] SEALING MEMBRANE AND METHOD OF SEALING

[76] Inventor: David Laventure, 97 Highview Ter., Manchester, N.H. 03104

[21] Appl. No.: 763,069

[22] Filed: Dec. 10, 1996

[51] Int. Cl.[6] ..... E02D 37/00

[52] U.S. Cl. ..... 52/514; 52/746.1; 156/249; 156/94; 428/40.1

[58] Field of Search ..... 52/514.5, 515, 52/516, 746.1, 746.11, 746.12, 514; 156/94, 249; 428/40.1, 63

[56] References Cited

U.S. PATENT DOCUMENTS 4,555,441 11/1985 Rothenberg ..... 428/40.1
5,490,892 2/1996 Castagnos et al. ..... 156/249 X
5,557,896 9/1996 Imeokparia et al. ..... 52/515 X

*Primary Examiner*—Creighton Smith
*Attorney, Agent, or Firm*—Daniel J. Bourque; Kevin J. Carroll

[57] ABSTRACT

A malleable sealing membrane is used to seal openings, regions or other apertures in a house or similar structures to prevent the entry of pests or other unwanted elements. The sealing membrane includes a mesh substrate having a sealing compound coated on one or more sides and embedded within interstices of the mesh substrate. One or more release backings cover the sealing compound to protect the sealing compound prior to the application of the sealing membrane. The sealing membrane is prefabricated for later use in sealing applications. In use, the sealing compound on one side of the mesh substrate is exposed, for example, by removing one of the release backings. The exposed sealing compound is applied against the structure along the opening, region or aperture. The second release backing can then be removed.

18 Claims, 2 Drawing Sheets

SEALING MEMBRANE AND METHOD OF SEALING

FIELD OF THE INVENTION

The present invention relates to sealing membranes and methods and in particular, to a malleable sealing membrane that is pre-fabricated from a mesh substrate coated with a sealing compound.

BACKGROUND OF THE INVENTION

In a house or similar structure, holes or openings must often be sealed or covered to prevent entry by pests, such as insects, rodents, or other animals, and other undesirable elements, such as plant growth, water, snow, ice and the like. One such hole or opening is often found beneath the siding and against the foundation of a house. Existing methods of sealing such openings involve the time consuming process of applying a caulking directly to the structure or to a substrate that has been applied separately over the opening in the structure. Such methods require a number of different steps to prepare the sealing materials and to seal or close the openings.

Accordingly, what is needed is a sealing membrane that is prefabricated and can be easily and quickly applied to seal or cover openings in a structure in a more efficient sealing process.

SUMMARY OF THE INVENTION

The present invention features a malleable sealing membrane for sealing at least one region in a structure. The malleable sealing membrane comprises a mesh substrate, such as a screen, having a first side and second side and a plurality of interstices extending through the mesh substrate. A sealing compound, such as a curable caulking, is coated on at least one of the first and second sides of the mesh substrate and embedded within the interstices. One or more release backings, such as a plastic film, cover the sealing compound coated on the respective first and/or second side of the mesh substrate, to enclose and contain the sealing compound prior to removing the one or more release backings.

Examples of the mesh substrate include a screen made of aluminum or fiberglass. Examples of the sealing compound include a curable caulking that is adherable to both wood and concrete.

The present invention also features a method for sealing at least one region in a structure, such as the region between the siding and the foundation of a house, using the prefabricated sealing membrane defined above. The method comprises: removing at least one release backing from the prefabricated sealing membrane; and applying the sealing membrane including sealing compound on one of the first and second sides of the mesh substrate against the structure proximate the region to be sealed, such that the region to be sealed is covered.

According to a preferred method, first and second release backings cover the sealing compound on respective first and second sides of the mesh substrate. The preferred method further includes the steps of removing the first release backing, exposing the sealing compound on the first side of the mesh substrate; applying the mesh substrate with the sealing compound on the first side of the mesh substrate against the structure proximate the region to be sealed; and removing the second release backing. The preferred method further includes, prior to removing the second release backing, applying pressure to the second release backing covering the sealing compound on the second side of the mesh substrate.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
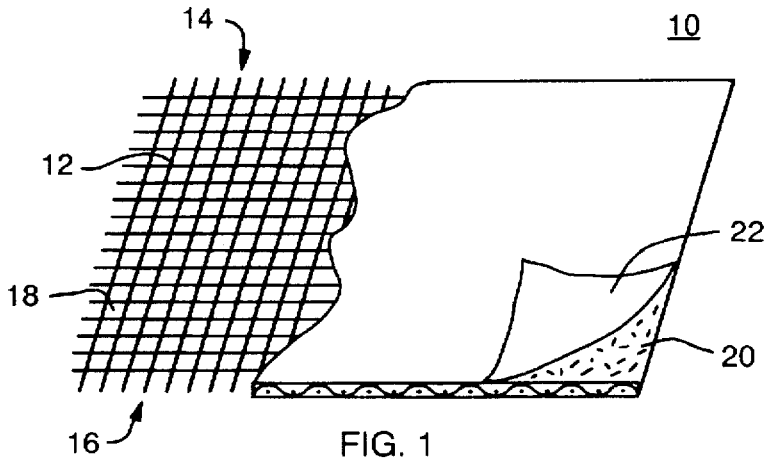
FIG. 1 is a partial cutaway perspective view of a sealing membrane according to the present invention.

A malleable sealing membrane 10, FIG. 1, according to the present invention, is used to seal or cover one or more openings, apertures, or regions in a house or other similar structure. The exemplary application of the malleable sealing membrane 10 is to prevent the entry of pests, such as insects, rodents and the like, into the apertures in a house, such as between the underside of the siding and the foundation. The present invention contemplates various other applications for the malleable sealing membrane 10 including, but not limited to, preventing the ingrowth of plants, preventing the entry of water, ice or snow, cold air, hot air and other unwanted elements.

The malleable sealing membrane 10 includes a mesh substrate 12 having first and second sides 14, 16 and a plurality of interstices 18. A sealing compound 20, such as a caulking, is disposed or coated on one or both of the first and second sides 14, 16. The sealing compound 20 is preferably disposed on both first and second sides 14, 16 and is embedded between and within the interstices 18 of the mesh substrate 12.

The malleable sealing membrane 10 further includes one or more release backings 22, such as plastic film, covering the sealing compound 20 on one or both of the first and second sides 14, 16 of the mesh substrate 12. The release backing 22 encloses and contains the sealing compound, prevents the curable sealing compound 20 from curing prior to application, and prevents contamination of the sealing compound.

Examples of the mesh substrate 12 include a screen made of fiberglass, cloth, aluminum, or other suitable metal or non-metal materials. One example of the mesh substrate 12 has a thickness of about 1/32 of an inch and a width of about 2 inches. The present invention, however, contemplates mesh substrates of various widths, lengths, and thicknesses. The preferred size of the interstices 18 is about 1/64 in. to 1/8 in. (e.g. window screen size).

Examples of the sealing compound 20 include both a curable and non-curable caulking that is adherable to both wood and concrete in a house or structure. One type of caulking is a latex or acrylic caulking such as that known as RED DEVIL® brand caulking. The sealing compound 20 can also include compounds for concrete mortar repair. The present invention contemplates any type of sealing compound that is adherable to the surfaces to which the sealing membrane is to be applied. The present invention further contemplates a sealing compound containing a pesticide. The sealing compound 20 preferably has a thickness in the range of about 1/16 in. to 1/8 in.

Figure 2A:
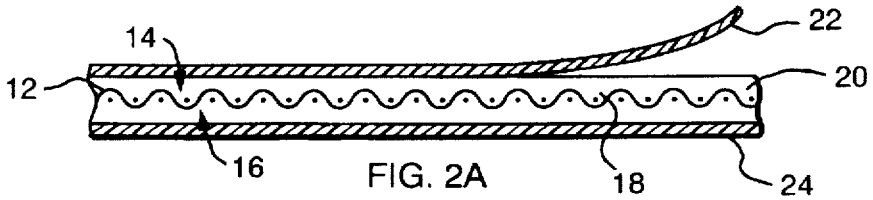
FIG. 2A is a side cross-sectional view of the sealing membrane according to one embodiment of the present invention.

According to the preferred embodiment, the malleable sealing membrane 10, FIG. 2A, includes the sealing compound 20 on both sides 14, 16 and embedded within the interstices 18 of the mesh substrate 12. The preferred embodiment also includes first and second release backings 22, 24 covering the sealing compound 20 on both the respective first and second sides 14, 16 of the mesh substrate 12. The first and second release backings 22, 24 enclose the protect the sealing compound and prevent a curable sealing compound 20 from curing before the malleable sealing membrane 10 is applied, thereby allowing the malleable sealing membrane 10 to be prefabricated and later used to seal the house or structure.

Figure 2B:
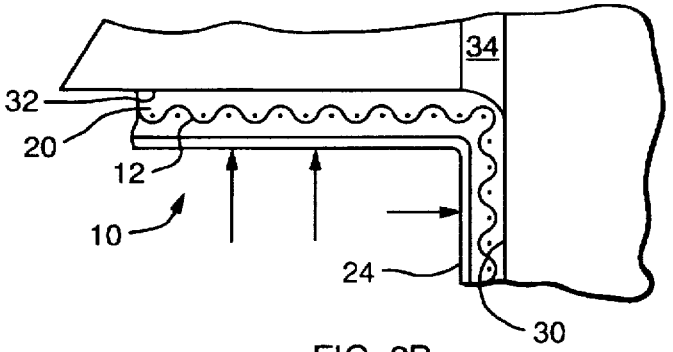
FIGS. 2B–2C are side cross-sectional views of the sealing membrane, according to one embodiment of the present invention, being applied to a structure.
Figure 2C:
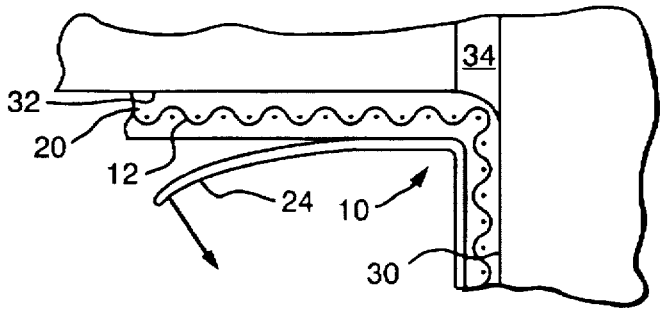

The method of sealing according to the present invention uses a malleable sealing membrane 10, FIGS. 2A–2C, that has been prefabricated and formed as a roll or as sheets. If the sealing membrane 10 includes first and second release backings 22, 24 the first release backing 22, FIG. 2A, is first removed to expose the sealing compound 20 on the first side 14 of the mesh substrate 12. The exposed sealing compound on the first side of the mesh substrate 12, FIG. 2B, is applied against one or more surfaces 30, 32 of a structure around or proximate an aperture or region 34 such that aperture or region 34 is covered. The second release backing 22 is left in place so that pressure can be applied to the sealing membrane 10, causing the sealing compound 20 to adhere to the surfaces 30, 32. Applying pressure to the second release backing 22 prevents having to directly contact or touch the sealing compound 20 during a sealing application, resulting in a neater and more efficient sealing process. The second release backing 24, if provided, is then removed to expose the sealing compound 20 covering the second side of the mesh substrate 12, FIG. 2C.

In another embodiment, the sealing membrane 10 is prefabricated with only one release backing. The sealing membrane 10 according to this embodiment could be formed as a roll such that the sealing compound on the uncovered side of the sealing membrane is not exposed. When the sealing membrane is unrolled, the sealing compound on the uncovered side of the mesh substrate is exposed and is applied to the structure around the aperture. Pressure is applied to the release backing on the covered side and then the release backing is removed.

Figure 3:
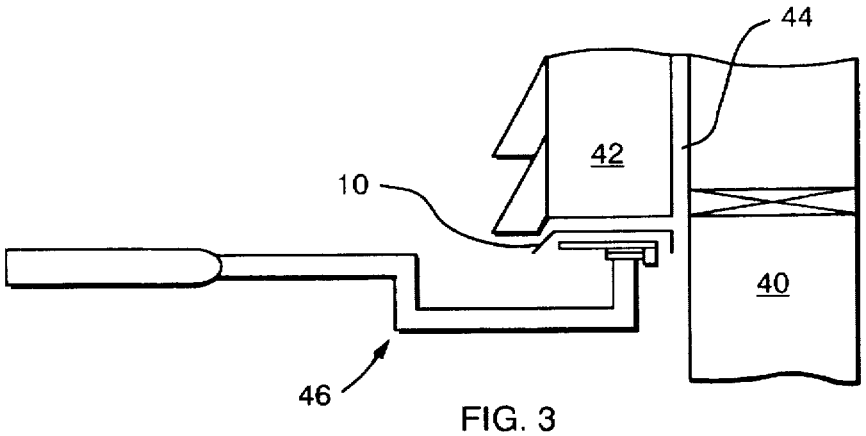
FIG. 3 is a side view of a device for applying the sealing membrane according to one embodiment of the present invention.

In one application of the present invention, the malleable sealing membrane 10, FIG. 3, is applied to the foundation 40 and underneath the siding 42 in a house. The malleable sealing membrane 10 conforms to fit the desired area of application and covers the aperture, region or crevice 44 between the foundation 40 and siding 42. A device 46 can be used to apply pressure to the malleable sealing membrane 10 causing the sealing membrane 10 to conform to the shape of the application area and adhere to the surfaces of the structure, such as the concrete of foundation 40 and wood of exterior sheathing or siding 42. The present invention also contemplates other applications and uses for the malleable sealing membrane.

Figure 4:
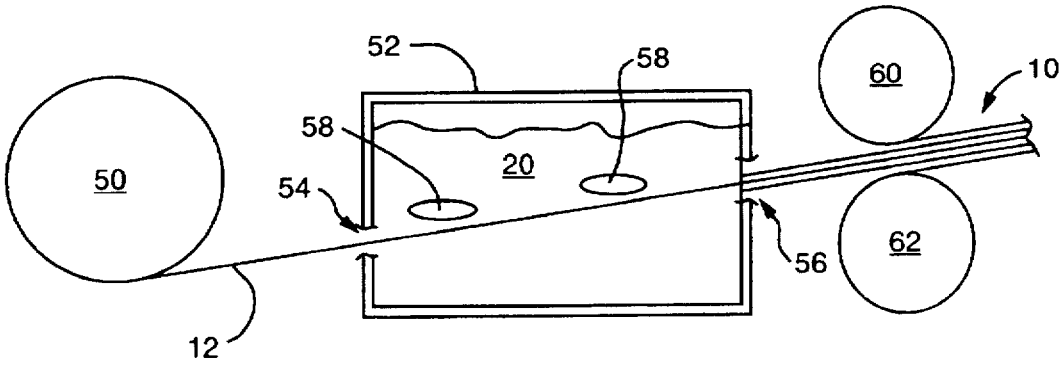
FIG. 4 is a schematic diagram of a system and method of making a sealing membrane according to one embodiment of the present invention.

One method of forming the malleable sealing membrane 20, FIG. 4, begins with a roll 50 of the mesh substrate 12. The mesh substrate 12 is fed from the roll 50 into a sealing compound receptacle 52, such as a tub or box, filled with the sealing compound 20, such as caulking. The mesh substrate 12 enters through a first slot 54 and the mesh substrate 12 coated with sealing compound 20 leaves through a second slot 56. One or more hold-down members 58, such as blades or pins, inside the receptacle 52 hold the mesh substrate 12 down into the sealing compound 20 without scraping the sealing compound 20 from the mesh substrate 12. Various shapes and configurations of the hold down members 58 can be used to vary the thickness or pattern of the sealing compound 20 coated on the mesh substrate 12.

One or more release backings can then be applied, for example, from one or more rolls 60, 62 of plastic film. The malleable sealing membrane 10 is thereby prefabricated for use at a later period of time in various sealing applications.

Accordingly, the malleable sealing membrane of the present invention quickly and effectively seals openings or regions in a house or structure to prevent entry of pests or other unwanted elements. The malleable sealing membrane is a prefabricated structure that can be efficiently applied at any time and without requiring numerous steps, such as separately attaching the substrate, preparing the caulking and separately applying the caulking to the substrate. The malleable sealing membrane also conforms to various areas to be sealed and is adherable to various types of surfaces.

Modifications and substitutions by one of ordinary skill in the art are considered to be within the scope of the present invention which is not to be limited except by the claims which follow.

What is claimed is:

1. A malleable sealing membrane for sealing at least one region of a structure, said malleable sealing membrane comprising:

a mesh substrate having a first side and a second side, said mesh substrate including a plurality of interstices extending through said mesh substrate from said first side to said second side;

a sealing compound coated on at least one of said first side and said second side of said mesh substrate and embedded within said plurality of interstices; and at least one release backing covering said sealing compound coated on said at least one of said first side and said second side of said mesh substrate, for protecting said sealing compound on said at least one of said first side and said second side prior to removing said at least one release backing.

2. The malleable sealing membrane of claim 1 wherein said mesh substrate includes a screen.

3. The malleable sealing membrane of claim 1 wherein said mesh substrate is made of at least one of aluminum and fiberglass.

4. The malleable sealing membrane of claim 1 wherein said sealing compound includes caulking.

5. The malleable sealing membrane of claim 1 wherein said sealing compound includes a caulking adherable to at least wood and concrete.

6. The malleable sealing membrane of claim 1 wherein said sealing compound includes an air curable sealing compound.

7. The malleable sealing membrane of claim 1 wherein said sealing compound is coated on both said first side and said second side of said mesh substrate.

8. The malleable sealing membrane of claim 7 wherein said at least one release backing includes a first release backing covering said sealing compound on said first side of said mesh substrate and a second release backing covering said sealing compound on said second side of said mesh substrate.

9. The malleable sealing membrane of claim 1 wherein said release backing includes a plastic film.

10. A malleable sealing membrane for sealing at least one aperture in a structure, said malleable sealing membrane comprising:

a screen having a first side and a second side, said screen including a plurality of interstices extending through said screen from said first side to said second side;

a curable caulking compound coated on said first side and said second side of said screen and embedded within said plurality of interstices; and first and second release backings covering said curable caulking compound coated on respective said first side and said second side of said screen, for preventing curing of said curable caulking compound prior to removing said first and second release backings and applying said malleable sealing membrane.

11. A method for sealing at least one region in a structure using a pre-fabricated sealing membrane comprising a mesh substrate, a sealing compound coated on at least one of first and second sides of said mesh substrate, and at least one release backing covering said sealing compound coated on said at least one of said first and second sides of said mesh substrate, said method comprising:

removing said at least one release backing from said pre-fabricated sealing membrane; and applying said sealing membrance with said sealing compound on one of said first and second sides of said mesh substrate against said structure around said at least one region to be sealed such that said at least one region is covered.

12. The method of claim 11 wherein said mesh substrate includes a screen having a plurality of interstices, said sealing compound being embedded in said plurality of interstices.

13. The method of claim 11 wherein said sealing compound includes a caulking adherable to at least wood and concrete.

14. The method of claim 11 wherein said at least one release backing includes first and second release backings covering said sealing compound on respective said first and second sides of said mesh substrate, said method further including the steps of:

removing said first release backing, exposing said sealing compound on said first side of said mesh substrate prior to applying said sealing compound on said first side of said mesh substrate against said structure around said at least one region to be sealed; and removing said second release backing.

15. The method of claim 14 wherein applying said sealing compound on said first side of said mesh substrate against said structure around said at least one region to be sealed includes applying pressure to said second release backing covering said sealing compound on said second side of said mesh substrate prior to removing said second release backing.

16. The method of claim 11 wherein said at least one release backing includes plastic film.

17. The method of claim 11 further including conforming said pre-fabricated sealing membrane to a shape of said structure around said at least one region to be sealed.

18. The method of claim 11 wherein said at least one region to be sealed is between a foundation and siding in a structure.

* * * * *